United States Patent [19]

Winner

[11] Patent Number: 4,926,774

[45] Date of Patent: May 22, 1990

[54] WIND PROPELLED APPARATUS

[75] Inventor: William K. Winner, White Salmon, Wash.

[73] Assignee: Bic Corporation, Milford, Conn.

[21] Appl. No.: 278,906

[22] Filed: Dec. 2, 1988

[51] Int. Cl.[5] ..... B63B 43/04

[52] U.S. Cl. ..... 114/123; 114/39.2

[58] Field of Search ..... 441/74, 79, 65, 66; 114/39.2, 39.1, 123, 345, 283

[56] References Cited

U.S. PATENT DOCUMENTS

| | | | |
|---|---|---|---|
| 3,455,261 | 7/1969 | Perrin | 114/39.2 |
| 3,935,607 | 2/1976 | Cantwell et al. | 114/345 |
| 4,348,971 | 9/1982 | Montgomery | 114/345 |
| 4,598,659 | 7/1986 | Chinnery | 114/39.2 |
| 4,838,196 | 6/1989 | Ingram | 114/347 |

FOREIGN PATENT DOCUMENTS

| | | | |
|---|---|---|---|
| 3639296 | 4/1988 | Fed. Rep. of Germany | 114/39.2 |
| 2084521 | 4/1982 | United Kingdom | 441/74 |

*Primary Examiner*—Joseph F. Peters, Jr.
*Assistant Examiner*—Edwin L. Swinehart
*Attorney, Agent, or Firm*—Pennie & Edmonds

[57] ABSTRACT

A wind propelled apparatus is disclosed which includes a surfboard having a wind-propulsion sail adapted to receive wind for motive power, and a training sleeve which surrounds a substantial portion of the surfboard and includes side pontoons or stabilizer tanks filled with air under pressure to stabilize the surfboard with respect to a longitudinal axis. The training sleeve is preferably of a woven fabric which is maintained in tension and snugly against the board and has a relatively non-skid surface for stepping by an operator. This function is useful in combination with the stabilizer tanks particularly as a training aid for novice operators, but may also be used as desired by experienced operators under extreme conditions.

26 Claims, 3 Drawing Sheets

WIND PROPELLED APPARATUS

BACKGROUND OF THE INVENTION

1. Field of the Invention

The invention relates to a wind propelled apparatus particularly sail boats, generally referred to as sailboards.

2. Description of the Prior Art

The present invention is directed to improvements in wind propelled surfboards. In particular, the improvement is specifically directed toward a training device for use in training novices to become expert sailboard operators in a manner which minimizes the risk of accidents and bodily damage.

Such sailboards are generally constructed of a lightweight synthetic material which contains an upper surface for stepping upon by the operator. This sailboard is generally operated by wind power with substantial control by expert sailboard operators. As with any sport, the development of control and dexterity requires time and patience. The problem arises with such sailboards in that a novice who is training to operate the surfboard may have difficulty in the beginning in controlling the surfboard so as to maintain stability and control.

Attempts have been made in the past to attach stabilizers to the sailboard hull (i.e. the sailboard less the sail rig) in the form of side pontoons or flotation tanks but such pontoons were attached by straps and/or other attachments which either lost tension under the wet operating conditions or provided potentially dangerous projections such as buckles or the like which can present a risk of injury to the operator. Accordingly, to date, such stabilizer tanks have not been provided successfully. The significance of such tanks in training becomes clear since they provide stability about the longitudinal—or roll axis—axis in the same manner that training wheels are used on a two-wheeled bicycle. Furthermore, to provide a non-skid surface for stepping by the operator would present to the novice a desirable environment in which to develop his or her skills in operating the sailboard. I have invented a training device which solves these prior art problems and which can be used not only for training a potential operator but by experienced operators as well for operating a surfboard under difficult conditions.

SUMMARY OF THE INVENTION

A wind propelled apparatus comprising body means adapted to support a user, wind-propulsion means adapted to receive wind for motive power, and means surrounding a substantial portion of the body means, the surrounding means comprising means to stabilize the body means with respect to at least one axis. By body means, I refer to the actual sailboard hull, i.e. the sailboard less the sail rig.

In a preferred embodiment, the invention relates to a wind propelled apparatus comprising body means adapted to support a user, wind propulsion means adapted to receive wind for motive power, means surrounding a substantial portion of the body means and maintained in a predetermined tensioned condition with respect to the body means, the surrounding means including a generally elongated enclosure means positioned along each side portion of the body means in longitudinal relation thereto, and the enclosure means each containing a medium which causes the enclosure means to provide flotation stability to the body means when the body means is positioned on water. Preferably the surrounding means comprises a material fabric sleeve configured and adapted to be fitted about the body means in relatively snug relation therewith. The material is preferably a non-skid nylon such as the brand nylon marketed by E. I. DuPont de Nemours, Wilmington, Del., under the registered trademark Cordura®. The Cordura® brand nylon sleeve is a woven material dimensioned and configured to be maintained under substantial tension with respect to the body means to provide a relatively skin-tight, non-slip relation with the body means. Further, the longitudinally extending stabilizing enclosure means each comprise inflatable side pockets formed as part of the sleeve means. The side pockets contain an inner gas impermeable lining capable of being inflated by pressurized air so as to correspondingly expand the outer fabric material of each pocket. The vinyl material enclosures are dimensioned with respect to the enclosures formed by the outer fabric sleeve portion such that inflating the vinyl material enclosures causes the outer fabric sleeve enclosures to be correspondingly inflated and maintained in tension by the inflationary forces provided by the inflated vinyl enclosures.

The apparatus according to the invention preferably includes at least one opening dimensioned and positioned to facilitate entry of the body means within the sleeve means, the opening having separable fastener means which selectively opens and closes the opening to retain the sleeve means in substantial surrounding relation with the body means. Further, a centerboard is positioned and configured to promote stability to the body member.

In its preferred form a training device is provided for use with a wind propelled apparatus wherein the wind propelled apparatus comprises body means adapted to support a user and having propulsion means adapted to receive wind for motive power which comprises, a fabric sleeve dimensioned and configured to be positioned about the body means in tensioned relation therewith, the fabric sleeve being formed of a relatively non-skid fabric at least the yarns of which are coated with ultra-violet impermeable coating means, at least one flotation tank formed by the fabric means and extending along each edge portion of the body means and formed as part of the sleeve means when the sleeve means is positioned about the body means, an inner liner of gas impermeable material positioned within each flotation tank, and means to introduce a gaseous medium under pressure into each of the inner liners and to prevent escape of the gaseous medium under pressure so as to cause the inner liner to become inflated such that the outer surface of the inner liner engages the inner surface of each fabric flotation tank to become pressurized against the edge portion of the body means, the gaseous pressure causing the central portion of the sleeve means to become dimensioned in tensioned relation with respect to the body means thereby preventing slippage between the sleeve means and the body means.

The inner liner of gas impermeable material is capable of containing gaseous air under pressure up to about 15 psi, preferably about 10 psi. The liner may be in the form of a separate air bag or it may comprise an inner lining of the fabric; alternatively, the fabric may be inherently air impermeable.

The preferred training device disclosed for use with a wind propelled apparatus comprises a fabric sleeve dimensioned and configured to be positioned about the body means in tensioned skin-tight relation therewith, the fabric sleeve being comprised of an upper panel and a lower panel dimensioned to be positioned respectively over the upper and lower surfaces of the body member, the fabric sleeve having an elongated fabric enclosure member extending between the upper and lower panel along each side of the body member and positioned to extend along the respective side portions of the body member, the fabric sleeve further having inner fabric panels connecting the upper and lower members on each side and forming an inner wall of each longitudinal fabric enclosure member, an air impermeable enclosure positioned within each fabric enclosure member and having means to introduce pressurized air within each air impermeable enclosure such that the resultant expansion of each air impermeable enclosure causes each outer fabric enclosure member to be placed in tension outwardly away from the body member, and the tension further being transmitted to the upper and lower panels of the sleeve member to cause the sleeve member to be tightly fitted about the body member thereby providing a non-slip/non-skid fabric sleeve over the body member with air-filled flotation tanks formed by the side enclosure members positioned along each side thereof to provide stability about a longitudinal axis extending through the center of the body member.

Preferably the fabric sleeve is constructed of panel members precisely cut to appropriate configuration and dimensions. Such panel members are preferably appropriately stitched together but may be connected by alternative connecting means, i.e. ultrasonic welding, gluing or the like. These panel members are preferably comprised of CORDURA® brand nylon material, a fabric which has been found to have suitable stitch characteristics to provide the desired skin-tight relation with the sailboard hull. However, other non-skid fabrics having equivalent stretch characteristics and anti-skid properties are also contemplated. In selecting a fabric, factors to be considered include stretch properties, wet and dry and hot and cold temperatures. It is necessary to obtain sufficient stretch characteristics such that the fabric sleeve fits the sailboard hull with sufficient skin-tight tension to prevent slippage therebetween and/or wrinkling.

Each panel member forms the inner side of each stabilizing fabric enclosure and contains an opening which is openable and closable by a zipper to facilitate insertion and removal of the air impermeable enclosure. Further, at least one of the upper and lower panel members of the sleeve member contains an opening which is openable and closable by a zipper and which is dimensioned for insertion of the body member into the sleeve member.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
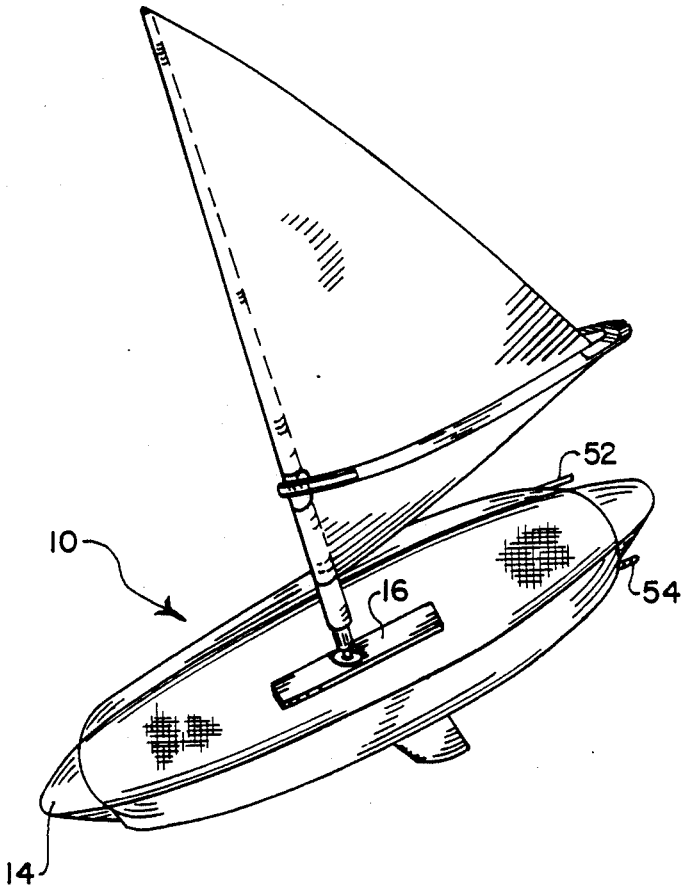
FIG. 1 is a perspective view of a flotation apparatus of the invention, contained within an outer training sleeve according to the invention.
Figure 2:
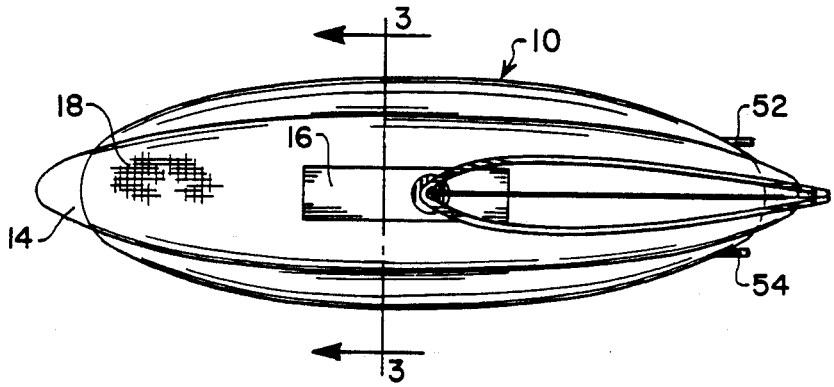
FIG. 2 is a top plan view of the flotation apparatus of FIG. 1 with mast rig removed, provided with an outer training sleeve constructed according to the invention.

Referring initially to FIGS. 1 and 2 a wind propelled flotation apparatus 10 containing an outer flotation trainer sleeve constructed according to the present invention is illustrated. The apparatus includes a conventional surfboard 14 which is usually constructed of a light weight material and is adapted for flotation and sufficient maneuvering over a body of water. The materials normally utilized for such surfboards include blow molded polyethylene, ASA or ABS thermoplastic material or the like. Although not shown, a mast which forms part of a rig is usually attached to the upper portion of the apparatus along the mast step 16 so as to attach a suitable sail device adapted to receive wind for propulsion.

Figure 3:
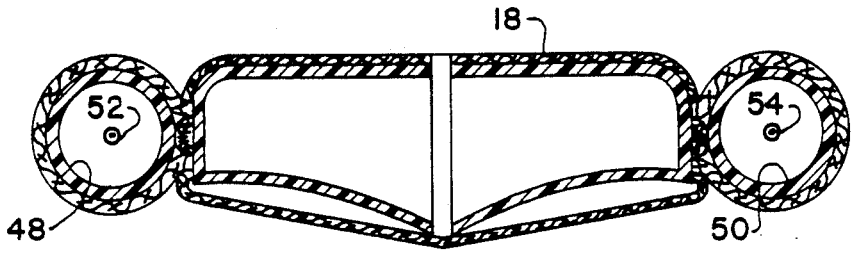
FIG. 3 is a cross-section of the flotation apparatus of FIG. 1 taken along lines 2—2 of FIG. 2.
Figure 4:
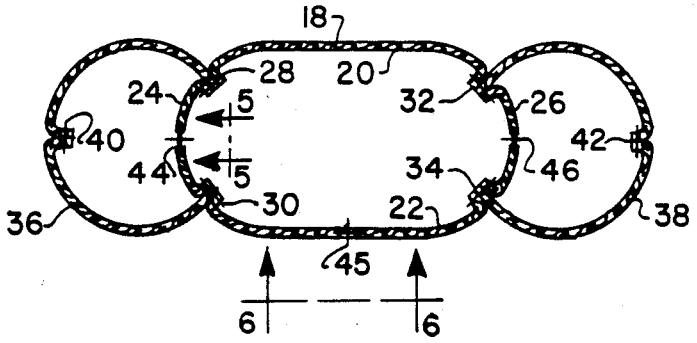
FIG. 4 is a cross-sectional view of the outer training sleeve constructed according to the invention, illustrating the method of construction of same.
Figure 5:
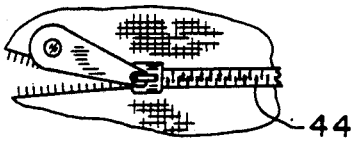
FIG. 5 is a view taken along lines 5—5 illustrating one of the zippered openings provided for insertion and removal of an air bag in each flotation tank.

Referring now to FIGS. 3 and 4 there is illustrated a cross-section of the apparatus shown in FIGS. 1 and 2. In FIG. 4 a cross-section of the apparatus is illustrated in which the details of the training sleeve 18 according to the invention are shown. The trainer sleeve 18 is preferably formed of an outer fabric woven from CORDURA® brand nylon material marketed by DuPont de Nemours, Wilmington, Del. The nylon material utilized for this fabric is a relatively high friction/high strength fabric which promotes easy stepping without slippage on the top of the surfboard. The fabric has excellent stretch properties which provides a skin-tight fit over the sailboard hull. The sleeve is preferably comprised of an upper panel 20 and a lower panel 22 with side panels 24 and 26 stitched as shown to the upper and lower panels by stitching 28, 30, 32 and 34 as shown. Alternatively, the sleeve can be constructed of less panels or be of substantially integral construction with at least one connecting seam.

Figure 6:
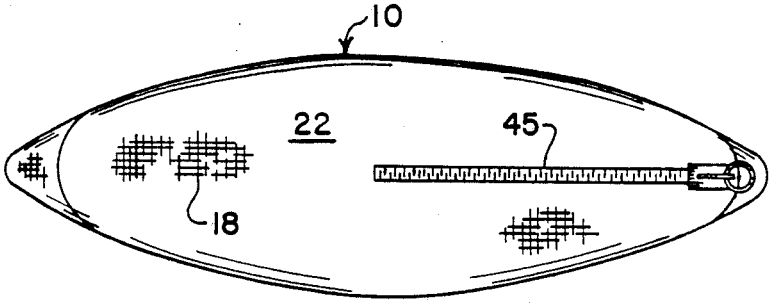
FIG. 6 is a bottom plan view of the apparatus of FIG. 1 illustrating the zippered opening for insertion of the surfboard into the training sleeve.

There is also provided a fabric flotation tank 36 and 38 stitched to the side panels on each side of the main sleeve 18. These flotation tanks include stitched seams 40 and 42 on the outer edges thereof. The inner panels 24 and 26 are respectively provided with an opening closable by zippers 44 and 46. A zipper 45 is provided longitudinally of the main sleeve 18 and extends from the generally central area to the rear end portion for insertion of the surfboard 10 into the main sleeve. Zipper 48 is provided on lower panel 22, as shown in FIG. 6. The zipper openings 44 and 46 are openable for respective insertion of vinyl bags 48 and 50 after which the zippered openings are closed. Each of these vinyl bags communicate with a pressured air valve 52 and 54 at the rear portion of the sailboard hull for introduction therein of pressurized air of preferably up to about 10 psi. This pressurized air causes the flotation tanks to expand and to place tension on the upper panel 20 and lower panel 22 of the main sleeve.

It will be appreciated that the combination of the non-skid surface of the nylon fabric material and the tension provided on each panel 20 and 22 creates a non-slip condition between the upper and lower panels of the main sleeve 18 and the two flotation tanks which prevents slippage therebetween and provides a relatively non-skid/non-slip surface for use by a user of the surfboard particularly inexperienced users during training. The non-skid surface thus provides a convenient stepping surface for the user while the flotation tanks on either side of the sailboard hull provide stability to the sailboard in a manner similar to the stability provided by trim tanks on large battleships. Thus, the stabilizing flotation tanks prevent rotation of the sailboard hull about a longitudinal axis (i.e. the roll axis) and thereby prevents the hull from flipping over upon itself in occurrences where the user may lose his or her footing or grip. Furthermore, the training sleeve thus described includes a minimum number of impediments to the user and thereby does not provide unnecessary dangers such as those provided by prior art attempts to stabilize such sailboards. In particular, those prior art attempts include straps, buckles and other devices having sharp corners, which not only provided impediments to the user but also presented unnecessary dangers to the user.

It should be understood that the training sleeve described herein can take numerous forms consistent with the present invention. For example, the construction of the outer sleeve may be varied in numerous ways and the inner air impermeable pressurized enclosures may be varied in construction and dimensions depending upon the size of the sailboard hull and the pressure desired within the flotation tanks as well as the desired net tension on the upper and lower panels of the training apparatus. In particular, the vinyl bags 48 and 50 constructed according to the present invention are formed by folding an elongated section of vinyl material about 8 mil. in thickness upon itself and by ultrasonically welding the seams with the resultant vinyl container being approximately 12 feet in length and approximately two to three inches in diameter at each end and tapering to about seven inches in diameter in the middle. These dimensions are only included to provide exemplary proportions between the length and width of the air impermeable enclosures and flotation. However, the air impermeable enclosures may take any configuration or dimensions which may be required for use with the flotation training device constructed according to the invention. Alternatively, the air impermeable enclosures may be substituted by utilizing an outer fabric which is air impermeable either by itself or by providing an inner air impermeable coating thereon.

In addition, any material having non-skid properties and sufficient strength may be utilized to form the outer fabric training sleeve 18. As noted, it is desirable to have sufficient stretch properties to encompass the hull in skin-tight relation sufficient to prevent slippage therebetween.

I claim:

1. A wind propelled apparatus comprising:

a. body means adapted to support a user;

b. wind-propulsion means adapted to receive wind for motive power; and c. sleeve means surrounding substantially all of said body means, said surrounding means comprising a stretchable fabric which surrounds and includes an inflatable side pocket positioned on each side of said body means and formed as part of said surrounding means to stabilize the body means with respect to at least one axis, said sleeve means being configured and adapted to be fitted about said body means in relatively snug relation therewith.

2. A wind propelled apparatus comprising:

a. body means adapted to support a user;

b. wind propulsion means adapted to receive wind for motive power;

c. sleeve means surrounding substantially all of said body means and maintained in a predetermined tensioned condition with respect to said body means, said surrounding means being comprised of a stretchable fabric which surrounds and includes a generally elongated enclosure means positioned along each side portion of said body means in longitudinal relation thereto, said sleeve means being configured and adapted to be fitted about said body means in relatively snug relation therewith; and d. said enclosure means each containing a medium which causes said enclosure means to provide flotation stability to said body means when said body means is positioned on water.

3. The apparatus according to claim 2 wherein said sleeve means has a relatively non-skid surface.

4. The apparatus according to claim 3 wherein said sleeve means is comprised of a material fabric having substantially non-skid properties.

5. The apparatus according to claim 4 wherein said sleeve means is comprised of nylon woven material.

6. The apparatus according to claim 5 wherein said sleeve means is dimensioned and configured to be maintained under substantial tension with respect to said body means to provide a relatively skin-tight, non-slip relation with said body means.

7. A wind propelled apparatus comprising:

a. body means adapted to support a user;

b. wind propulsion means adapted to receive wind for motive power;

c. means surrounding a substantial portion of said body mean and maintained in a predetermined tensioned condition with respect to said body means, said surrounding means comprising a sleeve means configured and adapted to be fitted about said body means in relatively snug relation therewith and including a generally elongated enclosure means positioned along each side portion of said body means in longitudinal relation thereto, said sleeve means being comprised of nylon woven material fabric having substantially non-skid properties and having a relatively non-skid surface, said sleeve means being dimensioned and configured to be maintained under substantial tension with respect to said body means to provide a relatively skin tight, non-skid relation with said body means; and d. said enclosure means each containing a medium which causes said enclosure means to provide flotation stability to said body means when said body means is positioned on water;

wherein said enclosure means each comprise inflatable side pockets formed as part of said sleeve means.

8. The apparatus according to claim 7 wherein said side pockets contain an inner gas impermeable lining.

9. The apparatus according to claim 8 wherein said inner gas impermeable lining is comprised of vinyl material capable of being inflated by pressurized air so as to correspondingly expand the outer fabric material of each pocket.

10. The apparatus according to claim 9 wherein said inner gas impermeable linings are dimensioned with respect to the enclosures formed by said fabric of said pockets such that inflating said linings causes said pockets to be correspondingly inflated and maintained in tension by inflationary forces provided by said inflated linings.

11. The apparatus according to claim 10 wherein said sleeve means includes at least one opening dimensioned and positioned to facilitate entry of said body means within said sleeve means, said opening having separable fastener means which selectively opens and closes said opening to retain said sleeve means in substantial surrounding relation with said body means.

12. The apparatus according to claim 10 further comprising a centerboard positioned and configured to promote stability to said body member.

13. A training device for use with a wind propelled apparatus wherein said wind propelled apparatus comprises body means adapted to support a user and having propulsion means adapted to receive wind for motive power which comprises:

a. a fabric sleeve dimensioned and configured to be positioned about said body means in tensioned relation therewith, said fabric sleeve being formed of a relatively non-skid fabric at least the yarns of which are coated with ultra-violet impermeable coating means;

b. at least one flotation tank formed by said fabric means and extending along each edge portion of said body means and formed as part of said sleeve means when said sleeve means is positioned about said body means;

c. an inner liner of gas impermeable material positioned within each flotation tank; and d. means to introduce a gaseous medium under pressure into each said inner liners and to prevent escape of said gaseous medium under pressure so as to cause said inner liner to become inflated such that the outer surface of said inner liner engages the inner surface of each fabric flotation tank to become pressurized against the side portion of said body means, said gaseous pressure causing the central portion of said sleeve means to become dimensioned in tensioned relation with respect to said body means thereby preventing slippage between said sleeve means and said body means.

14. The training device according to claim 13 wherein said inner liner of gas impermeable material is capable of containing gaseous medium under pressure up to about 15 psi.

15. The training device according to claim 14 wherein said gaseous medium under pressure is air.

16. The training device according to claim 13 wherein said fabric sleeve is comprised of nylon woven material.

17. The training device according to claim 16 wherein said sleeve contains at least one opening which is openable and closable to facilitate insertion and removal of said flotation tanks.

18. The training device according to claim 17 wherein said opening includes zipper means for selective connection or disconnection thereof.

19. A training device for use with a wind propelled apparatus wherein said wind propelled apparatus comprises a sailboard hull adapted to support a user and having propulsion means adapted to receive wind for motive power which comprises:

a. a fabric sleeve dimensioned and configured to be positioned about said hull in tensioned, substantially skin-tight relation therewith;

b. said fabric sleeve being comprised of an upper panel and a lower panel dimensioned to be positioned respectively over the upper and lower surfaces of the hull;

c. said fabric sleeve having an elongated fabric enclosure member extending between said upper and lower panel along each side of said hull and positioned to extend substantially along the respective side portions of said hull;

d. said fabric sleeve further having inner fabric panels connecting the upper and lower members on each side and forming an inner wall of each longitudinal fabric enclosure member;

e. an air impermeable enclosure positioned within each fabric enclosure member and having means to introduce pressurized air within each air impermeable enclosure such that the resultant expansion of each air impermeable enclosure causes each outer fabric enclosure member to be placed in tension outwardly away from the hull; and f. said tension further being transmitted to the upper and lower panels of said sleeve member to cause the sleeve member to be substantially tightly fitted about said hull thereby providing a non-slip/non-skid fabric sleeve over said hull with air-filled flotation tanks formed by said side enclosure members positioned substantially along each side thereof to provide stability about a longitudinal axis extending through the center of the hull.

20. The training device according to claim 14 wherein said fabric panel members are connected to each other by connecting means.

21. The training device according to claim 20 wherein said connecting means comprises fabric stitches.

22. The training device according to claim 21 wherein each panel member forming the inner side of each stabilizing fabric enclosure contains an opening which is openable and closable by a zipper to facilitate insertion and removal of said air impermeable enclosure.

23. The training device according to claim 19 wherein aid lower panel member of said sleeve member contains an opening which is openable and closable by a zipper and which is dimensioned for insertion of said body member into said sleeve member.

24. The training device according to claim 23 wherein said fabric sleeve is comprised of formed of a durable non-slip fabric.

25. The training device according to claim 24 wherein said durable non-slip fabric is nylon.

26. The training device according to claim 19 wherein said air impermeable enclosure is capable of containing air under pressure up to about 15 psi.

* * * * *